US011718106B2

(12) United States Patent
Praet et al.

(10) Patent No.: US 11,718,106 B2
(45) Date of Patent: Aug. 8, 2023

(54) APPARATUS AND METHOD FOR INKJET PRINTING ON FLEXIBLE WEBS

(71) Applicant: XEIKON MANUFACTURING N.V., Lier (BE)

(72) Inventors: Tomas Praet, Kortenberg (BE); Herman Jan Godelieve Van De Straete, Deurne (BE); Werner Jozef Johan Op De Beeck, Putte (BE); Roel De Mondt, Rumst (BE); Lode Erik Dries Deprez, Lier (BE)

(73) Assignee: XEIKON MANUFACTURING N.V., Lier (BE)

( * ) Notice: Subject to any disclaimer, the term of this patent is extended or adjusted under 35 U.S.C. 154(b) by 10 days.

(21) Appl. No.: 17/260,042

(22) PCT Filed: Jul. 15, 2019

(86) PCT No.: PCT/EP2019/069020

§ 371 (c)(1),
(2) Date: Jan. 13, 2021

(87) PCT Pub. No.: WO2020/016182

PCT Pub. Date: Jan. 23, 2020

(65) Prior Publication Data

US 2021/0276345 A1 Sep. 9, 2021

(30) Foreign Application Priority Data

Jul. 16, 2018 (NL) ..... 2021317

(51) Int. Cl.
*B41J 2/01* (2006.01)
*B41J 11/00* (2006.01)
(Continued)

(52) U.S. Cl.
CPC ..... *B41J 11/00214* (2021.01); *B41J 2/21* (2013.01); *B41J 11/00216* (2021.01); *B41J 15/04* (2013.01)

(58) Field of Classification Search
None
See application file for complete search history.

(56) References Cited

U.S. PATENT DOCUMENTS 9,145,007 B1 9/2015 Piatt et al.
2002/0166470 A1* 11/2002 Nedblake, Jr. ..... B41J 15/046 101/490
(Continued)

FOREIGN PATENT DOCUMENTS

CN 1519112 A * 8/2004 ..... B41J 11/002
CN 101987530 A 3/2011
(Continued)

OTHER PUBLICATIONS

International Search Report and Written Opinion for the International Patent Application No. PCT/EP2019/069020, dated Sep. 27, 2019, 10 pages.
(Continued)

*Primary Examiner* — Erica S Lin
*Assistant Examiner* — Tracey M McMillion
(74) *Attorney, Agent, or Firm* — KDW Firm PLLC

(57) ABSTRACT

An inkjet printing apparatus for printing on a substrate, such as a flexible packaging material, includes at least three inkjet heads including a first inkjet head, a second inkjet head, and at least one further inkjet head. At least one drying unit includes a first drying unit arranged opposite a first drying location which is located between the first and second inkjet location, the first drying unit being configured for physically removing liquid from ink applied by the first inkjet head. At least a first drum and a second drum, where the first and second inkjet locations as well as the first drying location are located on an outer surface of the first drum; and the at least one further inkjet location is located on an outer surface of the second drum.

19 Claims, 4 Drawing Sheets

(51) Int. Cl.
*B41J 2/21* (2006.01)
*B41J 15/04* (2006.01)

(56) References Cited

U.S. PATENT DOCUMENTS

| | | | | |
|---|---|---|---|---|
| 2010/0188468 | A1* | 7/2010 | Herpel | B41J 15/046 101/424.1 |
| 2011/0211012 | A1* | 9/2011 | Irita | B41J 2/2114 347/20 |
| 2018/0111388 | A1 | 4/2018 | Fujita et al. | |

FOREIGN PATENT DOCUMENTS

| | | | | |
|---|---|---|---|---|
| CN | 103561959 | A * | 2/2014 | B41F 23/0413 |
| EP | 2644391 | B1 | 10/2013 | |
| EP | 3395574 | A1 | 10/2018 | |
| JP | 2017128040 | A | 7/2017 | |
| WO | 2015016902 | A1 | 2/2015 | |
| WO | 2017110441 | A1 | 6/2017 | |
| WO | 2017207469 | A1 | 12/2017 | |
| WO | 2018029072 | A1 | 2/2018 | |

OTHER PUBLICATIONS

The Substantive Examination report dated Sep. 9, 2022, for European Patent Application No. EP19737773.2 (seven (7) pages).

* cited by examiner

APPARATUS AND METHOD FOR INKJET PRINTING ON FLEXIBLE WEBS

This is a national stage application filed under 35 U.S.C. § 371 of pending international application PCT/EP2019/069020, filed Jul. 15, 2019, which claims priority to Netherlands Patent Application No. 2021317, filed Jul. 16, 2018, the entirety of which applications are hereby incorporated by reference herein.

FIELD OF INVENTION

The field of the invention relates to inkjet printing, and in particular to inkjet printing on flexible substrates, such as flexible packaging materials, using a solvent based ink, and in particular a water-based ink. More in particular, the field of the invention relates to single pass inkjet printing on flexible webs using solvent-based inks, such as water-based inks.

BACKGROUND

In a typical inkjet apparatus for printing with a water-based ink, the substrate will first pass below a series of inkjet print heads, whereupon the substrate with printed portions is dried in a dryer station comprising e.g. a series of thermal dryers. Such systems work well for relatively thick ink-absorbing substrates.

Further digital printing apparatus and methods are known which use UV curable inks to print on thin flexible substrates such as packaging materials. In such a digital printing apparatus, a print head may be combined with a curing device, such that the printed portions are at least partially cured immediately after printing. In such systems typically a cooled drum is used in order to avoid that the thin flexible substrates deform (e.g. stretch or crimp) during curing.

SUMMARY

The object of embodiments of the invention is to provide an inkjet printing apparatus and method capable of printing in an improved manner with solvent-based inks, and in particular water-based inks, on different types of substrates, and in particular on thin flexible substrate which have no or limited solvent-absorption capacity.

According to a first aspect of the invention there is provided an inkjet printing apparatus for printing on a substrate, typically a flexible substrate, such as a flexible non-absorbing packaging material. The apparatus comprises at least two inkjet heads, a transport system, and at least one drying unit. The at least two inkjet heads include a first inkjet head and a second inkjet head arranged downstream of said first inkjet head, seen in a transport direction of the substrate through the printing apparatus. The transport system is configured for transporting the substrate from a first location opposite the first inkjet head to a second location opposite the second inkjet head. The at least one drying unit comprises a first drying unit arranged opposite a first drying location which is located, seen in the transport direction of the substrate, between the first and second inkjet location, said first drying unit being configured for physically removing liquid from ink applied by the first inkjet head. The transport system is configured to substantially continuously support the substrate between the first and second inkjet location.

By providing a first drying unit being configured for physically removing liquid from ink applied by the first inkjet head, first ink portions applied by the first inkjet head will be sufficiently dry when applying the second ink by the second inkjet head, resulting in an improved image quality of the resulting printed image on the substrate. Also, by providing a substantially continuously support of the substrate between the first and second inkjet location, the drying takes place while the substrate is well supported so that any deformation (such as stretching) of the substrate during the drying is limited or non-existing.

In embodiments of the inventions, typically a solvent-based ink, such as a water-based ink is used, and the physical removal of liquid implies that solvent, such as water, is removed, e.g. by evaporation. In other words, the ink is not cured but only dried. In embodiments of the invention preferably no curing of the ink takes place between the first and second inkjet head. In other embodiment the physical removal may comprise a removal of solvent by rolling contact with a layer having a selective affinity or adhesion with the solvent.

According to a preferred embodiment, the transport system comprises a moving part configured to move at a moving speed and to transport the substrate on said moving part from the first location to the second location at a speed which is substantially the same as the moving speed. In that way there is substantially no relative movement between a substrate support surface of the moving part and the substrate. The term "substantially the same" implies that the difference between the average moving speed and the average substrate speed is smaller than 5 percent, preferably smaller than 1 percent of the average moving speed. The moving part may be a part of a drum or a part of a belt.

According to a preferred embodiment, the transport system comprises at least a first drum, and the first and second locations as well as the first drying location are located on an outer surface of the first drum on which the substrate is transported. Using a drum has the advantage that the continuous support can be provided in an inexpensive way. Also, a drum has the advantage that a temperature of the drum surface can be well controlled. The first drum may have a diameter between 0.5 m and 5 m, more preferably between 0.5 m and 3 m.

More preferably, the at least two inkjet heads and the at least one drying unit associated with the first drum are positioned opposite an upper segment of the first drum, said upper segment describing an angle of less than 240°. If three or four or more inkjet heads are associated with the first drum, it is preferred that all three, four or five inkjet heads are positioned opposite an upper segment of the first drum, said upper segment describing an angle of less than 240°. In that way, flowing of the ink applied by the at least two inkjet heads due to gravity is limited, further improving the image quality of the printed image.

Even more preferably, the transport system comprises a second drum, and the apparatus comprises at least one further inkjet head associated with the second drum. The at least one further inkjet head associated with the second drum may comprise at least a first inkjet head and a second inkjet head arranged downstream of said first inkjet head seen in the transport direction of the substrate, wherein the second drum is configured for transporting the substrate from a first location opposite the first inkjet head associated with the second drum to a second location opposite the second inkjet head associated with the second drum, and wherein a drying unit is arranged between said first and second inkjet head, seen in the transport direction of the substrate. Preferably, the at least one further inkjet head associated with the second drum is positioned opposite an upper segment of the second drum, said upper segment describing an angle of less than 240°. Especially, when more than 4 colours need to be applied on the substrate, it can be advantageous to use two drums in order to avoid that the size of the drums need to be very large. For example, both the first and the second drum may have a diameter between 0.5 m and 5 m, more preferably between 0.5 m and 3 m. The transportation, installation, serviceability and maintenance of smaller drums are easier than that of larger drums. Also, because of the lower inertia, the starting and stopping of the movement of the drums will be faster for smaller drums.

According to a preferred embodiment no drying unit with a drying power larger than 50% of the drying power of the first drying unit is present between the first drum and the second drum seen along a transport path (T) of the substrate. In that way, the transport path between the first and the second drum does not need to be continuously supported and can be implemented in a simple manner using e.g. a series of guide rollers. Most preferably no drying unit is present between the first drum and the second drum.

According to a preferred embodiment there are no guide elements in contact with a printed side of the substrate between the first and second drum. In that manner, it is avoided that ink portions printed by the at least two inkjet heads associated with the first drum are disturbed by the guide elements.

According to a preferred embodiment the apparatus further comprises a main drying unit downstream of the transport system. This may be downstream of the first drum, and if both a first and second drum are present, downstream of the first and second drum. In an embodiment with a belt system, this may be downstream of the belt system. The main drying unit will ensure a full drying of the ink portions printed on the substrate.

According to another exemplary embodiment, the transport system comprises a belt system with a belt and a fixing means configured for fixing the substrate on the belt, and wherein the first and second locations as well as the drying location are located at an outer surface of the belt on which the substrate is transported. The fixing means may be a vacuum means configured to fix the substrate in the belt by suction. In addition or alternatively the fixing means may comprise a layer of the belt capable of sticking to the substrate.

According to another exemplary embodiment, the at least two inkjet heads comprise a third inkjet head arranged downstream of the second inkjet head, seen in a transport direction of the substrate through the printing apparatus. The apparatus then further comprises a second drying unit arranged, seen in the transport direction of the substrate, between the second and third inkjet head. The transport system is configured for transporting the substrate from the second location opposite the second inkjet head to a third location opposite the third inkjet head and to substantially continuously support the substrate between the second and third inkjet location. The at least two inkjet heads may comprise a fourth inkjet head arranged downstream of the third inkjet head, seen in a transport direction of the substrate through the printing apparatus, with a third drying unit arranged, seen in the transport direction of the substrate, between the third and fourth inkjet head. The transport system may then be configured for transporting the substrate from the third location opposite the third inkjet head to a fourth location opposite the fourth inkjet head and to substantially continuously support the substrate between the third and fourth inkjet location. Preferably, the first, second, third and fourth inkjet heads are configured to print four different colours. The term "colour" as used in the present application can be e.g. cyan, magenta, yellow, key (black), white, or specific spot colours, such as metallic, fluorescent, or custom hand-mixed inks. Also, two inkjet heads of the first, second, third and fourth inkjet heads may print the same colour, e.g. a "front" white and a "back" white. The skilled person understands that many combinations are possible depending on the desired application.

According to another exemplary embodiment, one or more additional application units may be provided associated with the transport system in order to apply a coating on the substrate before or after the printing with the inkjet heads. The additional application unit may be configured to apply e.g. a varnish or lacquer or primer. The application unit may be a roller configured to apply a more or less uniform coating layer, but may also be an application unit configured to apply a patterned coating. As for the inkjet heads, also the application unit may be combined with a drying unit.

According to a preferred embodiment, the transport system is configured to transport the substrate through the printing apparatus at a speed between 0.5 and 10 m/s, and preferably substantially continuously. The substrate may be moved at a substantially constant speed, but it is also possible to gradually increase or decrease the speed during certain periods of the printing operation. Preferably, the apparatus is configured for single pass printing and the at least two inkjet heads and optional further inkjet heads are stationary inkjet heads capable of printing across substantially the entire width of the substrate.

The drying unit is preferably a non-contact drying unit configured to evaporate the solvent (e.g. water) of the ink. According to a preferred embodiment, the at least one drying unit comprises any one of the following: an Ultraviolet (UV) dryer, a hot air dryer, an infrared (IR) or near-infrared (NIR) dryer, a microwave dryer, or any combination thereof.

According to another aspect of the invention, there is provided a method for inkjet printing on a substrate, preferably a flexible substrate such as a flexible packaging material, comprising the steps of:

- applying ink on a substrate at a first location using a first inkjet head;
- physically removing liquid from ink applied by the first inkjet head, at a drying location;
- after the removing step, applying ink at a second location using a second inkjet head.

The substrate is substantially continuously supported during transport from the first location to the drying location and from the drying location to the second inkjet location.

Preferably, the substrate is transported substantially continuously, e.g. at a substantially constant speed, from the first to the second location, for example at a speed between 0.5 and 10 m/s. Preferably, the method uses single pass printing, wherein the first and second inkjet heads are stationary inkjet heads capable of printing across substantially the entire width of the substrate.

According to a preferred embodiment, the substrate is transported on a drum and the applying and removing steps are performed on a portion of the substrate supported on the drum. More preferably, the substrate is transported from the drum to a second drum, and the following steps are performed on a portion of the substrate supported on the second drum: applying ink using a first inkjet head; physically removing liquid from ink applied by the first inkjet head; applying ink using a second inkjet head after said removing step.

Preferably the substrate is a flexible substrate, such as a flexible packaging material. Typically, the substrate will not absorb the solvent-based ink, or will absorb only a very limited amount of the solvent of the applied ink. Preferably, the substrate is a non-fibrous substrate. The substrate may comprise a layer of a synthetic polymer, such as normal or casted polyethylene, polypropylene or polyethylene terephthalate. Such plastics, which are for instance used in labels, have very low oil absorption capacity. In other embodiments, the substrate may have a coating with a very low absorption capacity. The substrate may be a label substrate comprising a glue layer arranged at one side of the substrate. The substrate is typically thin, having e.g. a thickness between 10 and 100 micron.

Other advantages and features disclosed above for the apparatus apply mutatis mutandis for the method.

BRIEF DESCRIPTION OF THE FIGURES

The accompanying drawings are used to illustrate presently preferred non-limiting exemplary embodiments of devices of the present invention. The above and other advantages of the features and objects of the invention will become more apparent and the invention will be better understood from the following detailed description when read in conjunction with the accompanying drawings, in which.

DESCRIPTION OF EMBODIMENTS

Figure 1:
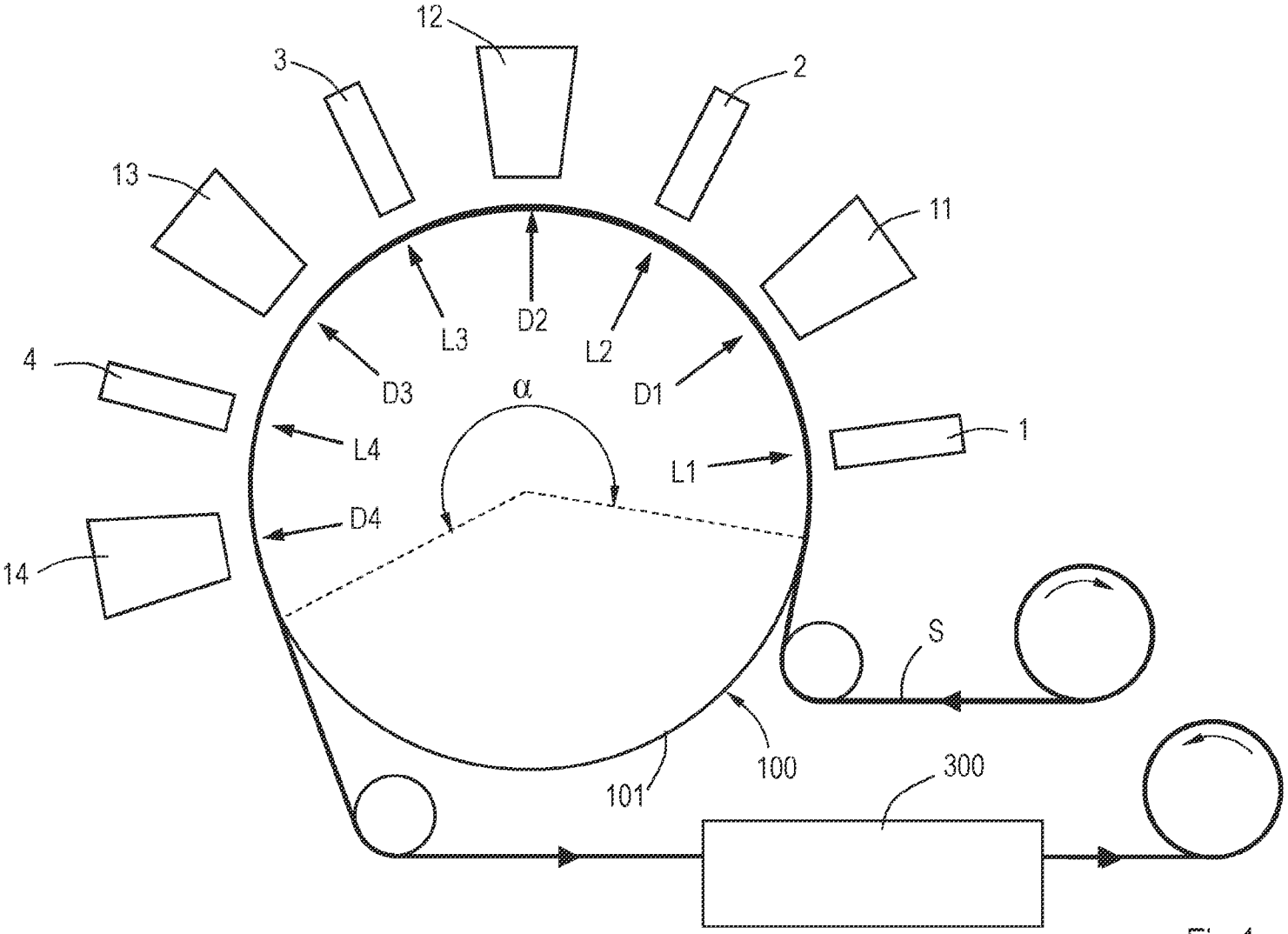
FIG. 1 is a schematic view of an exemplary embodiment of an inkjet printing apparatus with a single drum.

FIG. 1 illustrates a first exemplary embodiment of an inkjet printing apparatus for printing on a substrate (S), such as a thin flexible packaging material, using a solvent-based ink, typically a water-based ink. The apparatus comprises a transport system 100 comprising a drum 101, four inkjet heads 1, 2, 3, 4, and four drying units 11, 12, 13, 14, and a main drying unit 300.

The four inkjet heads include a first inkjet head 1, a second inkjet head 2 arranged downstream of the first inkjet head 1, a third inkjet head 3 arranged downstream of the second inkjet head 2, a fourth inkjet head 4 arranged downstream of the third inkjet head 3. The terms "downstream" and "upstream" define relative positions in the apparatus when looking in a transport direction of the substrate S through the printing apparatus. The inkjet heads 1, 2, 3, 4 may be stationary inkjet heads capable of printing over substantially the entire width of the substrate S.

The transport system 100 is configured for transporting the substrate from a first location L1 opposite the first inkjet head 1 via a second and third location L2, L3 opposite the second and third inkjet heads 2, 3, respectively, to a fourth location L4 opposite the fourth inkjet head 4. The transport system 100 is configured to substantially continuously support the substrate S between the first and fourth inkjet location L1, L4. The first to fourth locations L1-L4 are located at an outer surface of the drum 101 on which the substrate S is transported. The drum 101 forms a moving part configured to move at a moving speed and the transport system 100 is configured to transport the substrate S at a speed which is substantially the same as the moving speed. Preferably, the transport system 100 is configured to transport the substrate S through the printing apparatus at a substantially constant speed between 0.5 m/s and 10 m/s.

The four drying units 11, 12, 13, 14 comprise a first drying unit 11 arranged opposite a first drying location D1 which is located between the first and second inkjet location L1, L2, a second drying unit 12 arranged opposite a second drying location D2 which is located between the second and third inkjet locations L2, L3, a third drying unit 13 arranged opposite a third drying location D3, and a fourth drying unit 14 arranged opposite a fourth drying location D4. Each drying unit 11, 12, 13, 14 is configured for physically removing liquid from ink applied by the respective inkjet head 1, 2, 3, 4, e.g. by evaporation. In that way the printed ink portions are at least partially dried immediately after printing thereof and before printing the next portion. It is noted that in the embodiment of FIG. 1, the fourth drying unit may be omitted as the drying could also take place in the main drying unit 300. However, it may be advantageous to perform a partial drying in the fourth drying unit 104 in order to reduce any flow of ink between the fourth inkjet head 4 and the main drying unit 300. Each drying unit 11, 12, 13, 14 may comprise any one of the following: an Ultraviolet (UV) dryer, a hot air dryer, an infrared (IR) or near-infrared (NIR) dryer, a microwave dryer, or any combination thereof.

The four inkjet heads 1, 2, 3, 4 and the four drying units 11, 12, 13, 14 associated with the drum 101 are positioned opposite an upper segment of the drum 101. The upper segment may describe an angle $\alpha$ of less than 240°, preferably less than 200°. The first drum 101 may have a diameter between 0.5 and 5 m. The first, second, third and fourth inkjet heads 1, 2, 3, 4 may be configured to print four different colours.

The main drying unit 300 is located downstream of the transport system 100 in order to perform a full drying of the printed portions on the substrate.

Figure 2:
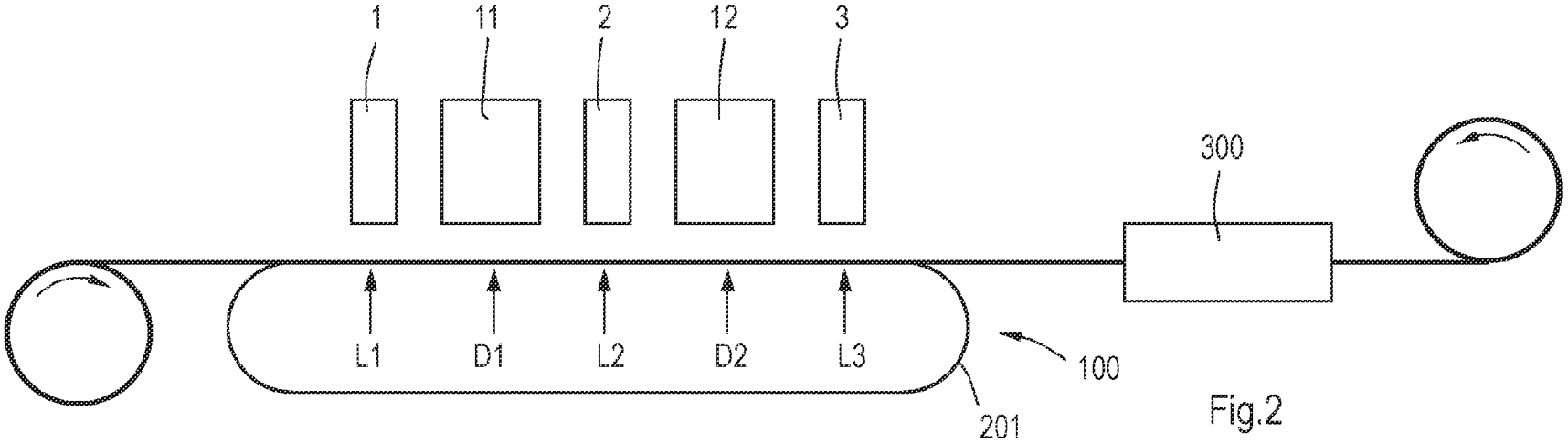
FIG. 2 is a schematic view of an exemplary embodiment of an inkjet printing apparatus with a belt transport system.

FIG. 2 illustrates another exemplary embodiment of an inkjet printing apparatus for printing on a substrate (S), using a solvent-based ink, typically a water-based ink. The apparatus comprises a transport system 100 comprising a belt system 201, three inkjet heads 1, 2, 3, two drying units 11, 12, and a main drying unit 300. Similar components have been indicated with the same reference numerals as in FIG. 1, and will not be described again.

The transport system 100 comprises a belt system 201 with a belt and a fixing means configured for fixing the substrate S on the belt. The first, second and third locations L1, L2, L3 as well as the first and second drying locations D1, D2 are located on an outer surface of the belt on which the substrate S is transported.

Figure 3:
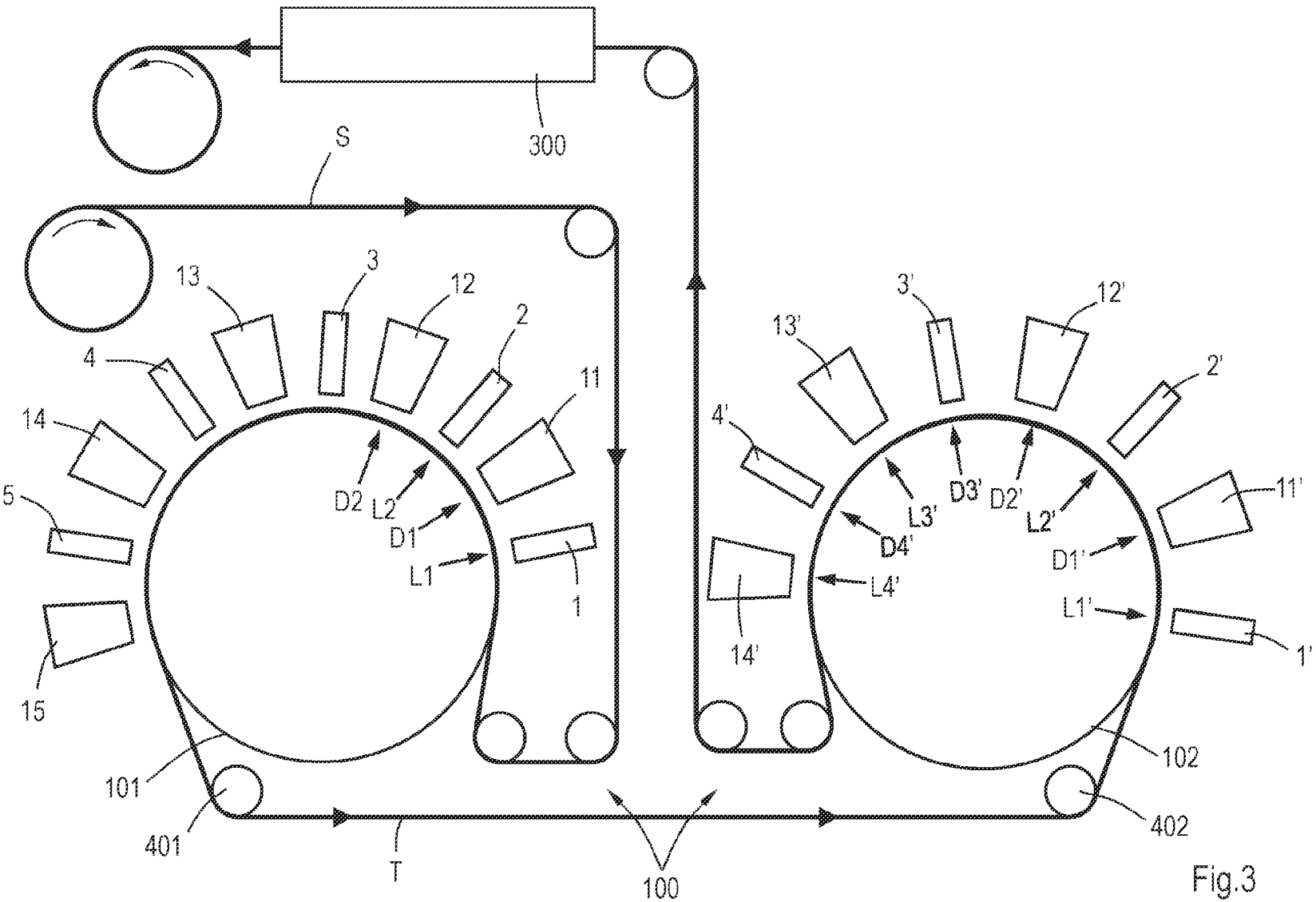
FIG. 3 is a schematic view of an exemplary embodiment of an inkjet printing apparatus with a first and second drum.

FIG. 3 illustrates another exemplary embodiment of an inkjet printing apparatus for printing on a substrate (S), using a solvent-based ink, typically a water-based ink. The apparatus comprises a transport system 100 comprising a first and a second drum 101, 102, five inkjet heads 1, 2, 3, 4, 5 and five drying units 11, 12, 13, 14, 15 associated with the first drum 101, four further inkjet heads 1', 2', 3', 4' and four further drying units 11', 12', 13', 14' associated with the second drum 102, and a main drying unit 300. Similar components have been indicated with the same reference numerals as in FIG. 1, and will not be described again.

The second drum 102 is associated with the four further inkjet heads comprising a first further inkjet head 1', a second further inkjet head 2' arranged downstream of said first further inkjet head 1', a third further inkjet head 3' arranged downstream of said second further inkjet head 2', and a fourth further inkjet head 4' arranged downstream of said third further inkjet head 3'. The second drum 102 is configured for transporting the substrate S from a first location L1' opposite the first further inkjet head 1' to respective second, third and fourth locations L2', L3', L4' opposite the second, third and fourth further inkjet heads 2', 3', 4'. The further drying units 11', 12', 13', 14' are arranged immediately downstream of the respective further inkjet heads 1', 2', 3', 4'. Preferably, the further inkjet heads 1', 2', 3', 4' associated with the second drum 102 are all positioned opposite an upper segment of the second drum 102, said upper segment describing an angle $\alpha$ of less than 240°, more preferably less than 200°, with no inkjet heads in the remaining lower segment.

As illustrated, preferably no drying unit is present between the first drum 101 and the second drum 102 seen along a transport path T of the substrate S, such that the substrate S does not have to be continuously supported between the first drum 101 and the second drum 102. Also, preferably there are no guide elements in contact with a printed side of the substrate S between the first drum 101 and second drum 102.

In FIG. 3, the substrate S leaves the first drum 101 at a lower segment of the first drum 101, and reaches the second drum 102 at a lower segment of the second drum 102. The guide rollers 401, 402 contact a back side of the substrate S, i.e. a non-printed side of the substrate S. Optionally some drying with a reduced amount of electrical power may take place between the first drum 101 and the second drum 102 (not illustrated).

Figure 4:
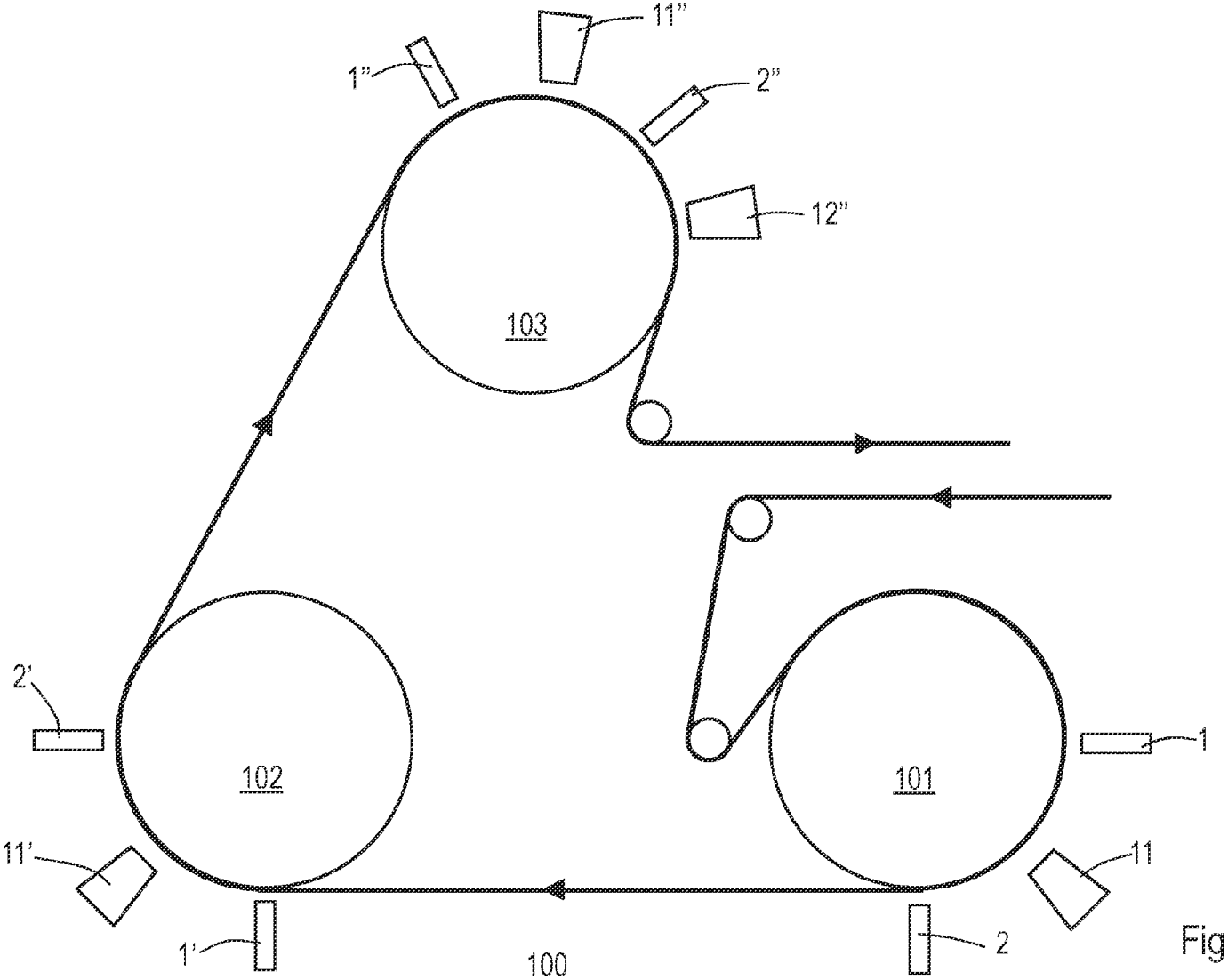
FIG. 4 is a schematic view of an exemplary embodiment of an inkjet printing apparatus with three drums.

FIG. 4 illustrates another exemplary embodiment of an inkjet printing apparatus for printing on a substrate (S), using a solvent-based ink, typically a water-based ink. The apparatus comprises a transport system 100 comprising a first, a second and a third drum 101, 102, 103, two inkjet heads 1, 2, and a drying unit 11 associated with the first drum 101, two further inkjet heads 1', 2' and a further drying unit 11' associated with the second drum 102, two further inkjet heads 1", 2" and two further drying units 11", 12" associated with the third drum 103. Similar components have been indicated with the same reference numerals as in FIGS. 1 and 3, and will not be described again.

As illustrated, preferably no drying unit is present between the first drum 101 and the second drum 102, and between the second drum 102 and the third drum 103, seen along a transport path T of the substrate S, such that the substrate S does not have to be continuously supported between the first drum 101 and the second drum 102 and between the second drum and the third drum. Also, preferably there are no guide elements in contact with a printed side of the substrate S between the first drum 101 and second drum 102 and between the second drum 102 and the third drum 103.

FIGS. 1-4 also illustrate exemplary embodiments of the method of the invention. The method comprising the steps of: applying ink on a substrate S at respective locations L1, L2, etc. using respective inkjet heads 1, 2, etc.; and physically removing liquid from ink applied by the respective inkjet heads 1, 2, etc., at respective drying locations D1, D2, etc.; wherein the substrate is substantially continuously supported between the respective locations L1, L2, etc. In FIGS. 1, 3 and 4 the substrate is transported on one or more drums 101, etc. and the applying and removing steps are performed on a portion of the substrate S supported on the one or more drums 101, etc. The substrate S is transported on a moving part (e.g. a part of the outer surface of the drum 101) at a speed which is substantially the same as a moving speed of the moving part. The temperature of the one or more drums 101, etc. may be controlled in order to avoid deformation of the substrate. For example the temperature may be controlled such that the substrate temperature does not exceed a predetermined value, e.g. a value between 30 and 90° C.

It is further noted that applying turning bars or rollers allows configurations of two, three or more drums with axes that are not substantially parallel, in order to make the embodiment more compact, or to increase the wrap around angles around the drums. For example, in the embodiment of FIG. 3 it is also possible to position the second drum 102 with its axis at an angle w.r.t. the axis of the first drum 101, and to use a turning bar or roller in between the first and second drum. Also, in the embodiment of FIG. 4, the second and/or third drum 102, 103 may be positioned such that their axis is at an angle w.r.t. the axis of the first drum 101.

Whilst the principles of the invention have been set out above in connection with specific embodiments, it is to be understood that this description is merely made by way of example and not as a limitation of the scope of protection which is determined by the appended claims.

The invention claimed is:

1. An inkjet printing apparatus for printing on a substrate, such as a flexible packaging material, comprising:

at least three inkjet heads including a first inkjet head, a second inkjet head, and at least one further inkjet head;

a transport system configured for transporting the substrate from a first location opposite the first inkjet head to a second location opposite the second inkjet head, to at least one further location opposite the at least one further inkjet head; and at least one drying unit comprising a first drying unit arranged opposite a first drying location which is located, seen in a transport direction of the substrate, between the first and second location, said first drying unit being configured for physically removing liquid from ink applied by the first inkjet head;

wherein the transport system comprises at least a first drum and a second drum on which the substrate is transported, and wherein the first and second locations as well as the first drying location are located on an outer surface of the first drum; and the at least one further location is located on an outer surface of the second drum, wherein there are no guide rollers in contact with a printed side of the substrate between the first and second drums.

2. The apparatus of claim 1, wherein the transport system comprises a moving part configured to move at a moving speed and to transport the substrate on said moving part from the first location to the second location at a speed which is substantially the same as the moving speed.

3. The apparatus of claim 1, wherein the first drying unit is configured for removing the liquid by evaporation.

4. The apparatus of claim 1, wherein the at least two inkjet heads and the at least one drying unit associated with the first drum are positioned opposite an upper segment of the first drum, said upper segment describing an angle of less than 240°, with no inkjet heads in a remaining lower segment.

5. The apparatus of claim 1, wherein no drying unit with a drying power larger than 50% of the drying power of the first drying unit is present between the first drum and the second drum seen along a transport path of the substrate.

6. The apparatus of claim 1, wherein the at least one further inkjet head associated with the second drum comprises at least a first inkjet head and a second inkjet head arranged downstream of said first inkjet head seen in the transport direction of the substrate, wherein the second drum is configured for transporting the substrate from a first location opposite the first inkjet head associated with the second drum to a second location opposite the second inkjet head associated with the second drum; and wherein a drying unit is arranged between said first and second inkjet head, seen in the transport direction of the substrate.

7. The apparatus of claim 1, wherein the at least one further inkjet head associated with the second drum is positioned opposite an upper segment of the second drum, said upper segment describing an angle of less than 240°, with no inkjet heads in a remaining lower segment.

8. The apparatus of claim 1, wherein the first drum and/or the second drum has a diameter between 0.5 and 5 meters (m).

9. The apparatus of claim 1, further comprising a main drying unit downstream of the transport system.

10. The apparatus of claim 1, wherein the at least three inkjet heads comprise a third inkjet head arranged opposite the first drum, downstream of the second inkjet head seen in a transport direction of the substrate through the printing apparatus; and wherein the apparatus further comprises a second drying unit arranged, seen in the transport direction of the substrate, between the second and third inkjet head.

11. The apparatus of claim 10, wherein the at least three inkjet heads comprise a fourth inkjet head arranged opposite the first drum, downstream of the third inkjet head seen in a transport direction of the substrate through the printing apparatus; and wherein the apparatus comprises a third drying unit arranged, seen in the transport direction of the substrate, between the third and fourth inkjet head.

12. The apparatus of claim 11, wherein the first, second, third and fourth inkjet heads are configured to print four different colours.

13. The apparatus of claim 1, wherein the transport system is configured to transport the substrate through the printing apparatus at a speed between 0.5 and 10 meters/second (m/s).

14. The apparatus of claim 1, wherein the at least one drying unit comprises one or more of: an Ultraviolet (UV) dryer, a hot air dryer, an infrared (IR) or near-infrared (NIR) dryer, a microwave dryer, or any combination thereof.

15. A method for printing on a substrate, preferably a flexible substrate such as a flexible packaging material, using at least three inkjet heads, said method comprising:

applying ink on a substrate at a first location on a first drum using a first inkjet head of said at least three inkjet heads;

physically removing liquid from ink applied by the first inkjet head, at a drying location on the first drum;

after the removing step, applying ink at a second location on the first drum using a second inkjet head of said at least three inkjet heads;

transporting the substrate from the first drum to a second drum, wherein there are no guide rollers in contact with a printed side of the substrate between the first and second drums; and applying ink on the substrate at least one further location on the second drum using at least one further inkjet head of said at least three inkjet heads.

16. The method of claim 15, wherein applying ink on the substrate at least one further location on the second drum comprises: applying ink using a further first inkjet head associated with the second drum; removing liquid from ink applied by the further first inkjet head; and applying ink using a further second inkjet head associated with the second drum, after said removing step.

17. The method of claim 15, wherein the substrate is transported from the first drum to the second drum such that a printed side of the substrate is not brought in contact with any elements; and wherein the liquid is removed by evaporation.

18. The method of claim 15, wherein the substrate is a non-fibrous flexible substrate.

19. The method of claim 15, wherein the substrate is transported on a moving part from the first location to the second location at a speed which is substantially the same as a moving speed of the moving part.

* * * * *